US006382553B1

(12) United States Patent
Lewis et al.

(10) Patent No.: US 6,382,553 B1
(45) Date of Patent: May 7, 2002

(54) STACKABLE CORELESS ROLL CARRIAGE UNIT ADAPTER FOR DISPENSERS

(75) Inventors: Richard Paul Lewis, Marietta; Stephen Lawrence Phelps, Lilburn; Antwain Demone Taylor, Suwanee, all of GA (US)

(73) Assignee: Kimberly Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/702,467

(22) Filed: Oct. 31, 2000

(51) Int. Cl.[7] ..... B65H 16/06; B65H 49/18

(52) U.S. Cl. ..... 242/596.7; 242/594.4; 242/596.8; 242/599.3

(58) Field of Search ..... 242/596, 596.1, 242/596.3, 596.5, 596.7, 596.8, 594, 594.4, 594.5, 598.3, 598.5, 599.3, 560, 559.4

(56) References Cited

U.S. PATENT DOCUMENTS

| | | | |
|---|---|---|---|
| 1,217,211 | A | 2/1917 | Pico |
| 1,229,431 | A | 6/1917 | Farrell |
| 1,778,282 | A | 10/1930 | Stewart |
| 2,049,964 | A | 8/1936 | Lawson |
| 2,555,885 | A | 6/1951 | Hope |
| 2,566,883 | A | 9/1951 | Gove |
| 2,583,411 | A | 1/1952 | Carlin |
| 2,643,069 | A | 6/1953 | Carlin |
| 2,819,852 | A | 1/1958 | Sarro |
| 2,879,012 | A | 3/1959 | Sarro |
| 2,905,404 | A | 9/1959 | Simmons |
| 3,729,145 | A | 4/1973 | Koo et al. |
| 3,865,295 | A | 2/1975 | Okamura |
| 4,307,639 | A | 12/1981 | DeLuca |
| 4,340,195 | A | 7/1982 | DeLuca |
| 4,383,656 | A | 5/1983 | Campbell |
| 4,444,359 | A | 4/1984 | Butler |
| 4,452,403 | A | 6/1984 | Arronte |
| 4,497,453 | A | 2/1985 | Butcher |
| 4,522,346 | A | 6/1985 | Jespersen |
| 4,535,947 | A | 8/1985 | Hidle |
| 4,553,710 | A | 11/1985 | Pool |
| 4,564,148 | A | 1/1986 | Wentworth |
| 4,614,312 | A | 9/1986 | Del Pino |
| 4,634,067 | A | 1/1987 | White |
| 4,662,576 | A | 5/1987 | Paul |
| 4,732,340 | A | 3/1988 | Toya |
| 4,762,259 | A | 8/1988 | Kosa |
| 4,762,288 | A | 8/1988 | Eckels |

(List continued on next page.)

*Primary Examiner*—William A. Rivera
(74) *Attorney, Agent, or Firm*—Karl V Sidor

(57) ABSTRACT

A carriage unit adapter for solid or coreless rolls of paper material that are dispensed in a roll dispenser having slots defined on inner surfaces of side wall members thereof for receipt of said adapter and a back wall positioned a distance from the slots that is slightly greater than the radius of a solid or coreless roll. The carriage unit adapter includes: a pair of spaced apart arms joined by a connecting member having a front surface and a back surface, each arm having an outboard surface and an inboard surface including: (i) an outboard pin disposed on the outboard surface, the outboard pin configured to slidably engage a slot on an inner surface of a side wall member of the dispenser; and (ii) an inboard pin attached to the inboard surface, the inboard pin configured to engage a coreless roll of material. Each spaced apart arm has a length measured from the back surface of the connecting member to the center of the outboard pin that is greater than the distance between the slots and the back wall of the dispenser so that the back surface of the connecting member contacts the back wall of the dispenser to force the connecting member out of the same planar dimension as the outboard pins as they engage the slots. Each spaced apart arm further includes vertical separation elements.

19 Claims, 16 Drawing Sheets

U.S. PATENT DOCUMENTS 4,821,974 A 4/1989 Poehlein
4,830,301 A 5/1989 Miler
4,974,783 A 12/1990 Campbell
5,149,003 A 9/1992 Tharp
5,192,044 A 3/1993 Baskin
5,205,455 A 4/1993 Moody
5,253,818 A 10/1993 Craddock
5,277,375 A 1/1994 Dearwater
5,322,234 A 6/1994 Robert et al.
5,366,175 A 11/1994 Schutz
5,370,336 A 12/1994 Whittington
5,370,339 A 12/1994 Moody et al.
5,385,318 A 1/1995 Rizzuto
5,451,013 A 9/1995 Schutz
5,495,997 A 3/1996 Moody
5,669,576 A 9/1997 Moody
5,676,331 A 10/1997 Weber
5,697,576 A 12/1997 Bloch et al.
5,813,624 A 9/1998 Grasso et al.
5,868,335 A 2/1999 Lebrun
5,868,342 A 2/1999 Moody et al.
5,868,347 A 2/1999 Paul et al.
5,904,316 A 5/1999 Dunning et al.
6,138,939 A * 10/2000 Phelps et al. ..... 242/596.7

* cited by examiner

STACKABLE CORELESS ROLL CARRIAGE UNIT ADAPTER FOR DISPENSERS

FIELD OF THE INVENTION

The present invention relates generally to adapters for rolled material dispensers, and more particularly to adapters for rolled material dispensers which permit a dispenser of cored rolls of material to dispense coreless rolls of material.

BACKGROUND

Commercial and consumer absorbent paper products such as toilet tissue and paper towels are typically distributed and dispensed in roll form, and nearly always include a hollow cylindrical core that the product is wrapped about. While the core may be formed of many different materials, the core is frequently formed of some type of cardboard, which may be glued together and to the product so that the core stays intact and the product does not separate from the core. The product is then dispensed by mounting the roll on a spindle, such as can be found on the common bathroom toilet roll dispenser, that passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Dispensers for multiple cored rolls of paper material, such as rolls of bathroom tissue, are also well known in the art. With typical conventional dispensers of this type, two rolls of tissue are vertically oriented within the dispenser so that the top roll falls into a dispensing position when the bottom roll is depleted. Generally, these dispensers are configured for conventional cored rolls incorporating a hollow core or spindle which extends through the roll, the ends of the spindle engaging slots or pathways which are defined in the interior surfaces of the dispensers.

A recent development in the industry of rolled paper products is solid or "coreless" rolls of material, such as, for example, bathroom tissue paper. These solid or coreless rolls do not contain a hollow spindle or hollow core of any type. In many instances, these solid or coreless rolls are formed of material which is wound throughout the diameter of the roll. In such rolls, a divot, recess or detent may be formed in each side of the paper roll which define a rotational axis for the roll.

As used herein, the term "coreless roll" further includes those rolls which are formed from material which is wound substantially, but not entirely, throughout the diameter of the roll. A coreless roll which is wound substantially throughout its diameter would lack a conventional cardboard or plastic core but would still incorporate a central aperture through the roll at the center of the roll along the length of the winding axis. Coreless rolls of this type are disclosed in, for example, U.S. Pat. Nos. 5,669,576; 5,467,936; 5,387,284; 5,281,386; 5,271,575; and 5,271,137.

Coreless rolls disclosed by these patents are formed by winding the material about a mandrel and then removing the roll from the mandrel so that the roll includes a central aperture which extends entirely through the width of the roll along the winding axis. The central aperture may generally serve as a mounting divot, recess or detent although its depth will be the entire length of the central aperture along the winding axis. Accordingly, the depth of such a mounting hole would be equal to the entire width of the coreless roll.

As used herein, the "width" of the roll refers to the distance between a first flat end of the coreless roll that defines a mounting hole and a second flat end of the coreless roll that defines a mounting hole. Desirably, each flat end of the coreless roll defines a mounting hole at substantially the center of the winding axis of the roll and at least one, and desirably each, mounting hole has a depth and has sides generally perpendicular to the end of the roll, the sides being separated by a distance that is less than the depth of the hole.

There are advantages and disadvantages associated with the coreless rolls. Coreless rolls are ecologically superior to cored rolls because no adhesives or throwaway materials are used to make the product. In addition, more product can be provided in the space that would otherwise have been occupied by the core. Cored rolls are more expensive to manufacture than coreless rolls because of the expense of making the cores and joining the cores to the product. In addition, coreless rolls have the advantage of being subject to less pilferage in commercial locations because of their inherent incompatibility with conventional dispensers.

A disadvantage of coreless rolls is that conventional dispensers are unable to dispense multiple solid or coreless rolls because they do not hold the coreless rolls within the dispensers and maintain the rolls in proper alignment. Thus, when a user desires to switch from conventional rolls incorporating a hollow core or spindle to coreless rolls, a new dispenser must be purchased and installed. To avoid this additional cost and labor, an adapter is needed which enables a user to easily and inexpensively adapt a conventional roll dispenser to dispense coreless rolls of material.

SUMMARY OF THE INVENTION

The present invention is directed to an adapter for a dual roll, vertically stacked dispenser. The adapter includes, in selected embodiments, a frame which fits within a dispenser of conventional cored rolls of material. In selected embodiments, the frame may include a base and a pair of spaced apart side rails, each side rail extending upwardly from the base. In such an embodiment, a rear support may also be provided which extends upwardly from the base and may be positioned with respect to the side rails so as to form a channel. In some embodiments, an upper rail may be provided which extends between and is attached to an upper portion of each of the spaced apart side rails and the rear support.

At least one carriage unit is provided in the present invention, each carriage unit having a pair of spaced apart arms. In certain embodiments, a crossbar may be provided which may extend between the spaced apart arms. Each arm may include an outboard surface and an inboard surface.

An outboard pin may be disposed on the outboard surface of each arm, the outboard pin being configured to slidably engage the dispenser. In certain embodiments, the outboard pin may engage a channel within the dispenser. An inboard pin may be provided, the inboard pin being rotatably attached to the inboard surface of each arm. The inboard pin is also adapted to engage a coreless roll of material.

A locking mechanism may further be provided which releasably locks the carriage unit to the frame. In particular embodiments of the present invention, the locking mechanism may include a flexible locking finger disposed upon each arm. In such an embodiment, the carriage unit may be inserted into the frame until the crossbar is positioned proximate to the rear support and the locking finger on each arm engages one of the side rails of the frame, releasably locking the carriage unit to the frame. Thus, the carriage unit is slidably retained within the channel of the frame.

The carriage unit may further include two brackets, each bracket slidably attached to one of the arms of the carriage unit so that the motion of each bracket along the arm of the carriage unit is substantially perpendicular to the motion of the carriage unit along the frame.

The present invention further encompasses a carriage unit adapter for solid or coreless rolls of paper material that are dispensed in a roll dispenser having slots defined on inner surfaces of side wall members thereof for receipt of said adapter and a back wall positioned a distance from the slots that is slightly greater than the radius of a solid or coreless roll, the solid or coreless rolls having recesses defined in sides thereof defining a rotating axis for said solid or coreless rolls.

According to the invention, the carriage unit adapter includes a pair of spaced apart arms joined by a connecting member having a front surface and a back surface, each arm having an outboard surface and an inboard surface including: (i) an outboard pin disposed on the outboard surface, the outboard pin configured to slidably engage a slot on an inner surface of a side wall member of the dispenser; and (ii) an inboard pin attached to the inboard surface, the inboard pin configured to engage a coreless roll of material. Each arm has a length measured from the back surface of the connecting member to the center of the outboard pin that is greater than the distance between the slots and the back wall of the dispenser so that the back surface of the connecting member contacts the back wall of the dispenser to force the connecting member out of the same planar dimension as the outboard pins as they engage the slots. This permits the carriage unit to hold said roll within the roll dispenser while allowing said carriage unit to move along the slots defined in said roll dispenser to a dispensing position without interfering with the positioning of subsequent rolls.

In an aspect of the invention, each spaced apart arm can be offset to orient to connecting member out of the same planar dimension as the outboard pins as they engage the slots. For example, each spaced apart arm may be offset at an angle ranging from about 10 degrees to about 75 degrees. As another example, each spaced apart arm may be offset at an angle ranging from about 30 degrees to about 50 degrees. As yet another example, each spaced apart arm may be offset at an angle of about 40 degrees.

The carriage unit adapter may also include finger placement indicia and thumb placement indicia on separate spaced apart arms.

Another aspect of the present invention encompasses a stackable carriage unit adapter for solid or coreless rolls of paper material that are dispensed in a roll dispenser having slots defined on inner surfaces of side wall members thereof for receipt of said adapter and a back wall positioned a distance from the slots that is slightly greater than the radius of a solid or coreless roll, the solid or coreless rolls having recesses defined in sides thereof defining a rotating axis for said solid or coreless rolls, the carriage unit adapter. In this aspect of the invention, the stackable carriage unit adapted includes a pair of spaced apart arms joined by a connecting member having a front surface and a back surface, each arm having an outboard surface and an inboard surface including: (i) an outboard pin disposed on the outboard surface, the outboard pin configured to slidably engage a slot on an inner surface of a side wall member of the dispenser; and (ii) an inboard pin attached to the inboard surface, the inboard pin configured to engage a coreless roll of material. Each arm has a length measured from the back surface of the connecting member to the center of the outboard pin that is greater than the distance between the slots and the back wall of the dispenser so that the back surface of the connecting member contacts the back wall of the dispenser to force the connecting member out of the same planar dimension as the outboard pins as they engage the slots. This configuration permits the stackable carriage unit hold the roll within the roll dispenser while allowing the carriage unit to move along the slots defined in the roll dispenser to a dispensing position.

Each arm of the stackable carriage unit also includes an upper surface and a lower surface and a vertical separation element located on at least a portion of the upper surface of each of the spaced apart arms.

According to the invention, the vertical separation elements each may have a vertical height that is approximately the same as the radius of a full roll of paper material to be dispensed. This height may be adjusted for several factors including, but not limited to, the dimensions of the dispenser.

Generally speaking, the vertical separation element of a first stackable carriage unit is adapted to contact or engage at least a portion of the lower surfaces of the spaced apart arms of a second stackable carriage unit when the second carriage unit is positioned directly on top of the first carriage unit.

Desirably, the vertical separation element of the first stackable carriage unit is adapted to contact or engage at least a portion of the lower surfaces of the spaced apart arms of the second stackable carriage unit when the second carriage unit is positioned directly on top of the first carriage unit and when the roll of paper product held in the first carriage unit is substantially depleted.

DETAILED DESCRIPTION OF THE INVENTION

Figure 1:
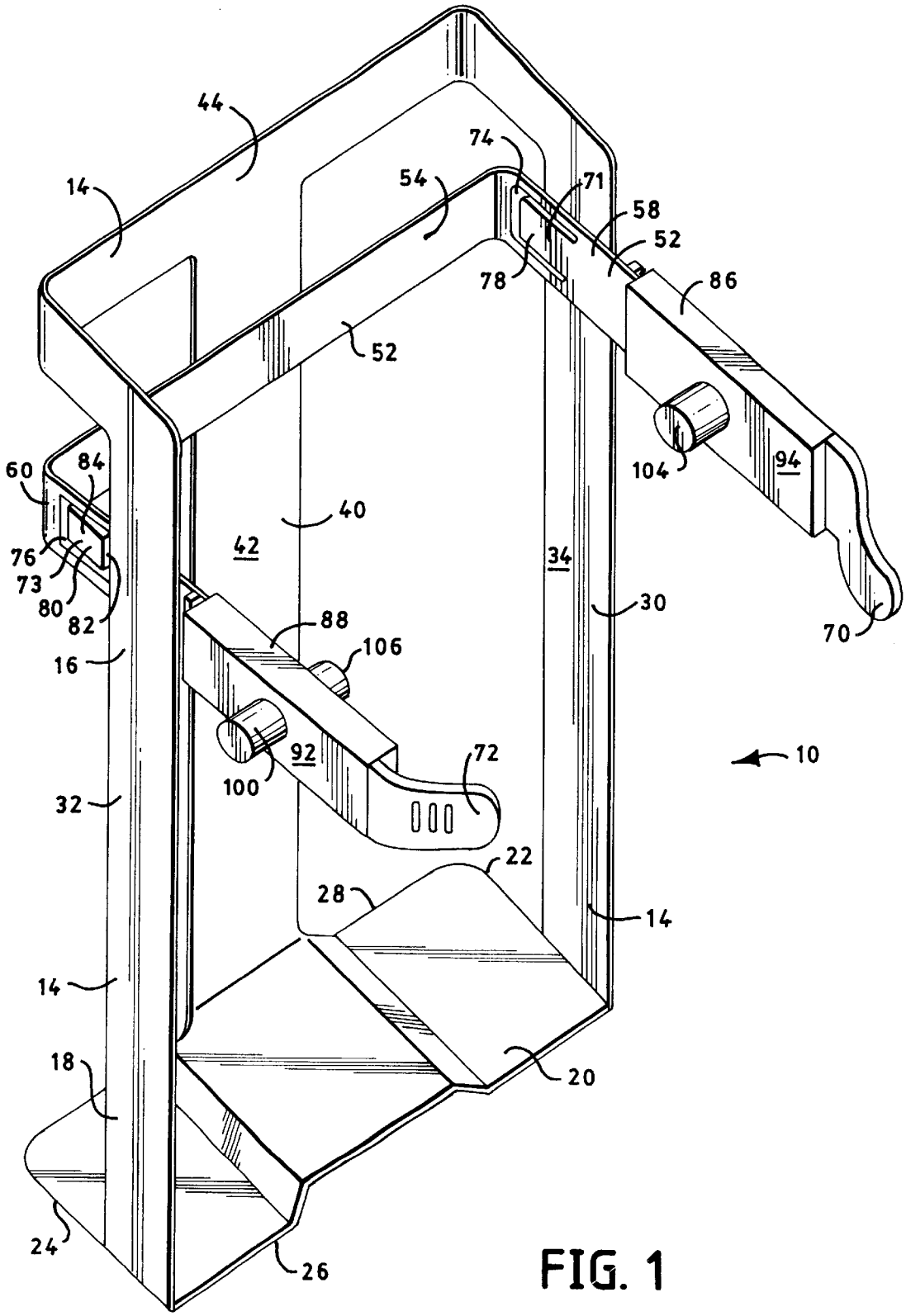
FIG. 1 is a perspective view of an embodiment of an adapter according to the present invention.

The adapter of the present invention permits multiple solid or coreless rolls of material to be dispensed from dispensers originally configured to dispense conventional rolls of material, each such roll having a hollow tube or core through which a spindle may be inserted. It is contemplated that configurations of the adapters may work with both hollow core rolls and solid or coreless rolls.

Reference will now be made in detail to various embodiments of the invention, one or more examples of which are illustrated in the drawings. Each example is provided by way of explanation of the invention, and not meant as a limitation of the invention. For example, features illustrated or described as part of one embodiment can be used in another embodiment to yield still a further embodiment. It is intended that the present invention cover such modifications and variations coming within the scope and spirit of the invention.

The present invention is illustrated and described in relation to a dispenser for bathroom tissue only for illustrative purposes, and this should not be interpreted as a limitation of the invention. It should be understood and appreciated that the present invention has uses in any application wherein coreless rolls of material, and not necessarily paper material, are to be dispensed from a dispensing device. Some other materials include, for example, non-woven fabrics, films, textiles, screens, meshes, and composites or laminates including one or more of the above.

As used herein, the term "coreless" refers to rolls which do not include a hollow tube or hollow core through which a spindle device may be inserted. Thus, a roll of material having a solid or non-hollow core is referred to herein as a coreless roll of material. Additionally, a roll of material which is wound substantially through its diameter and having a central aperture which extends along the winding axis is also considered to be a coreless roll of material.

The present invention will now be described with reference to the attached figures. An adapter for a dual roll, vertically stacked dispenser is illustrated in FIG. 1 at 10. Selected embodiments of the adapter include a frame 14. Although the frame 14 may have many configurations, the frame 14 of the embodiment shown in FIG. 1 is approximately C-shaped. The frame 14 may be a single piece, unitary construction, or may be comprised of a plurality of interconnected members.

Figure 2:
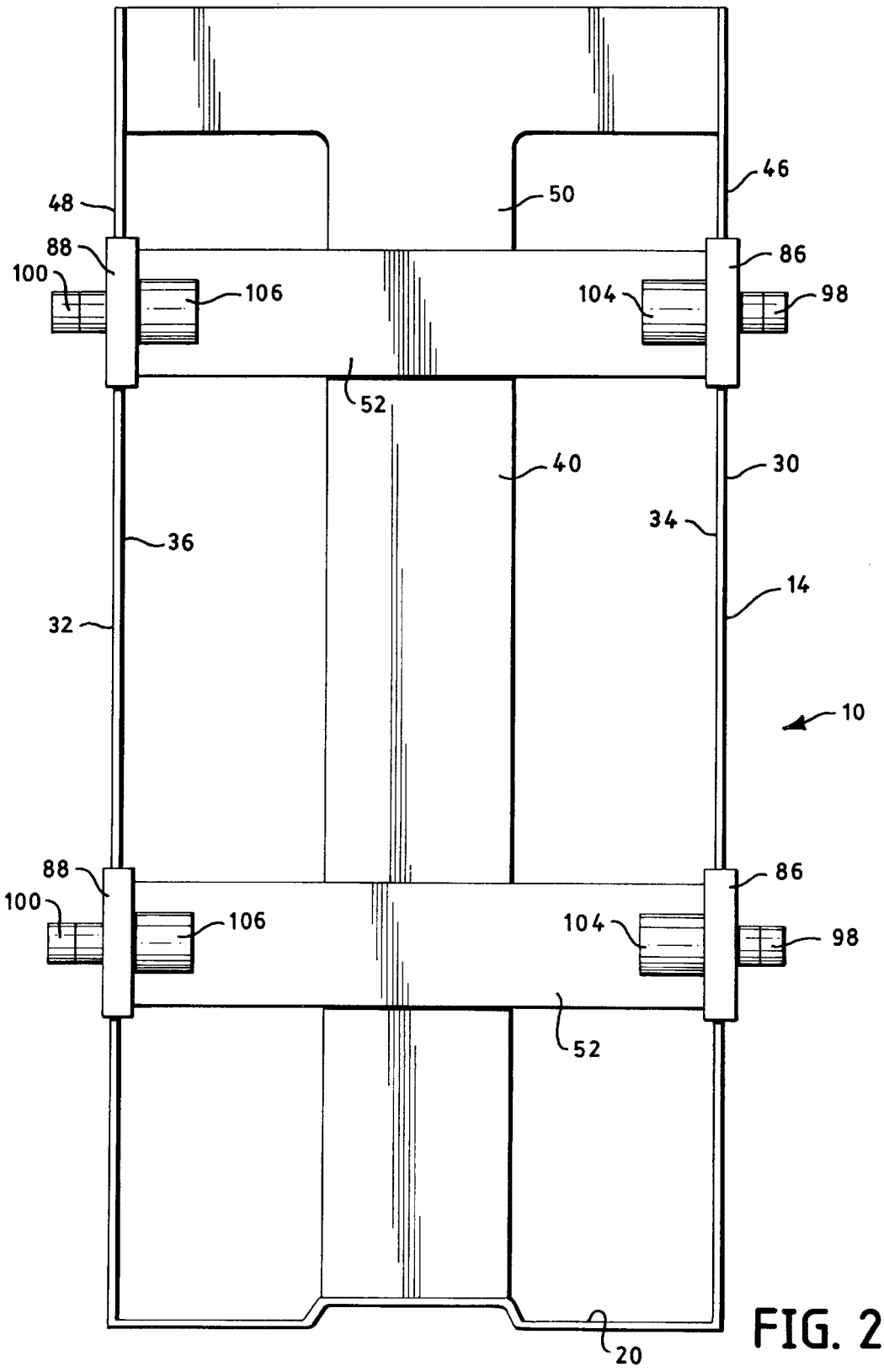
FIG. 2 is a front view of an adapter according to the present invention, the adapter utilizing two carriage units.
Figure 3:
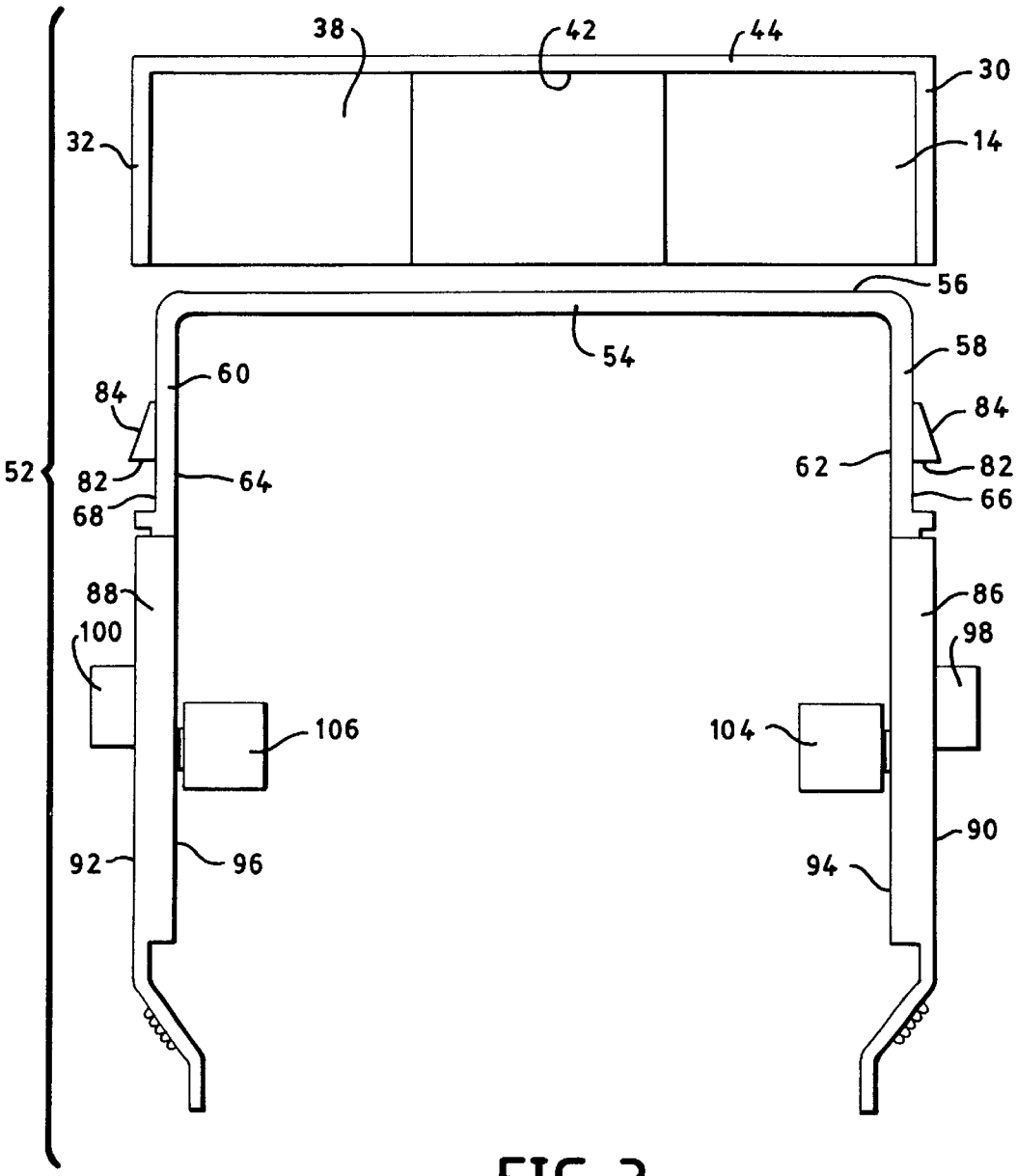
FIG. 3 is an exploded view of an embodiment of the adapter including a frame and a carriage unit.
Figure 4:
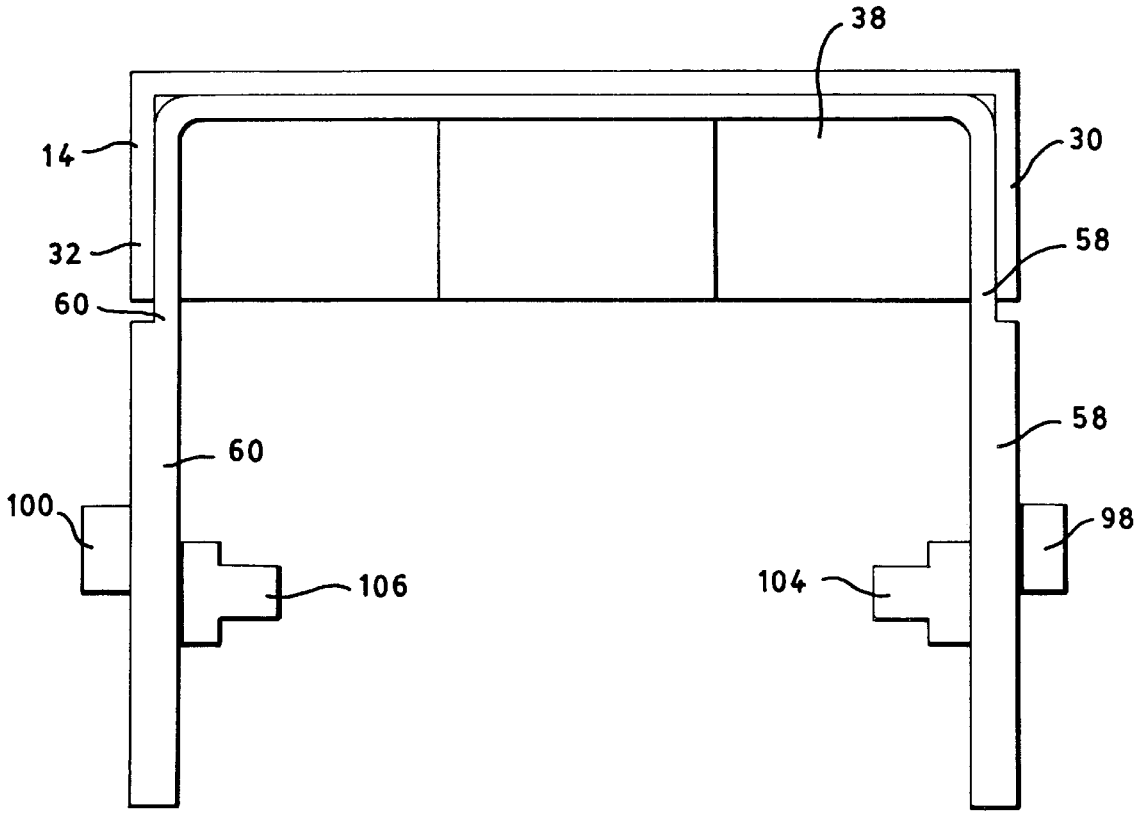
FIG. 4 is a top view of an adapter according to the present invention, illustrating the carriage unit engaging the frame.

In the embodiment depicted in FIG. 1, the frame 14 includes an upper portion 16 and a lower portion 18. A base 20 is provided, the base 20 including a pair of side edges 22 and 24, a front edge 26 and a rear edge 28. A pair of spaced apart side rails 30 and 32 extend upwardly from the base 20 proximate to the side edges 22 and 24, respectively. A rear support 40 may be provided which extends upwardly from the base 20 proximate to the rear edge 28. The rear support 40 may include an inboard surface 42. As illustrated in FIG. 2, the side rails 30 and 32 may include the inboard surfaces 34 and 36, respectively. An upper rail 44 may also be included in the frame 14. The upper rail 44 may be attached to and extend between the upper portion 46 of the side rail 30, the upper portion 48 of the side rail 32, and the upper portion 50 of the rear support 40. As best shown in FIGS. 3 and 4, the frame 14 forms a channel 38 extending along at least a portion of the length of the frame 14.

The frame 14 may be formed as a single unitary construction or multiple sections of interconnected materials. In some embodiments, the frame 14 may be substantially solid. In such embodiments, a plurality of grooves, apertures, and raised surfaces may be formed in the frame to enable the frame to properly engage the carriage units and dispense coreless rolls of material.

The frame and carriage units of the present invention may be formed from a variety of materials, such as, for example, metals, ceramics, plastics, and combinations of such and similar materials.

Figure 5:
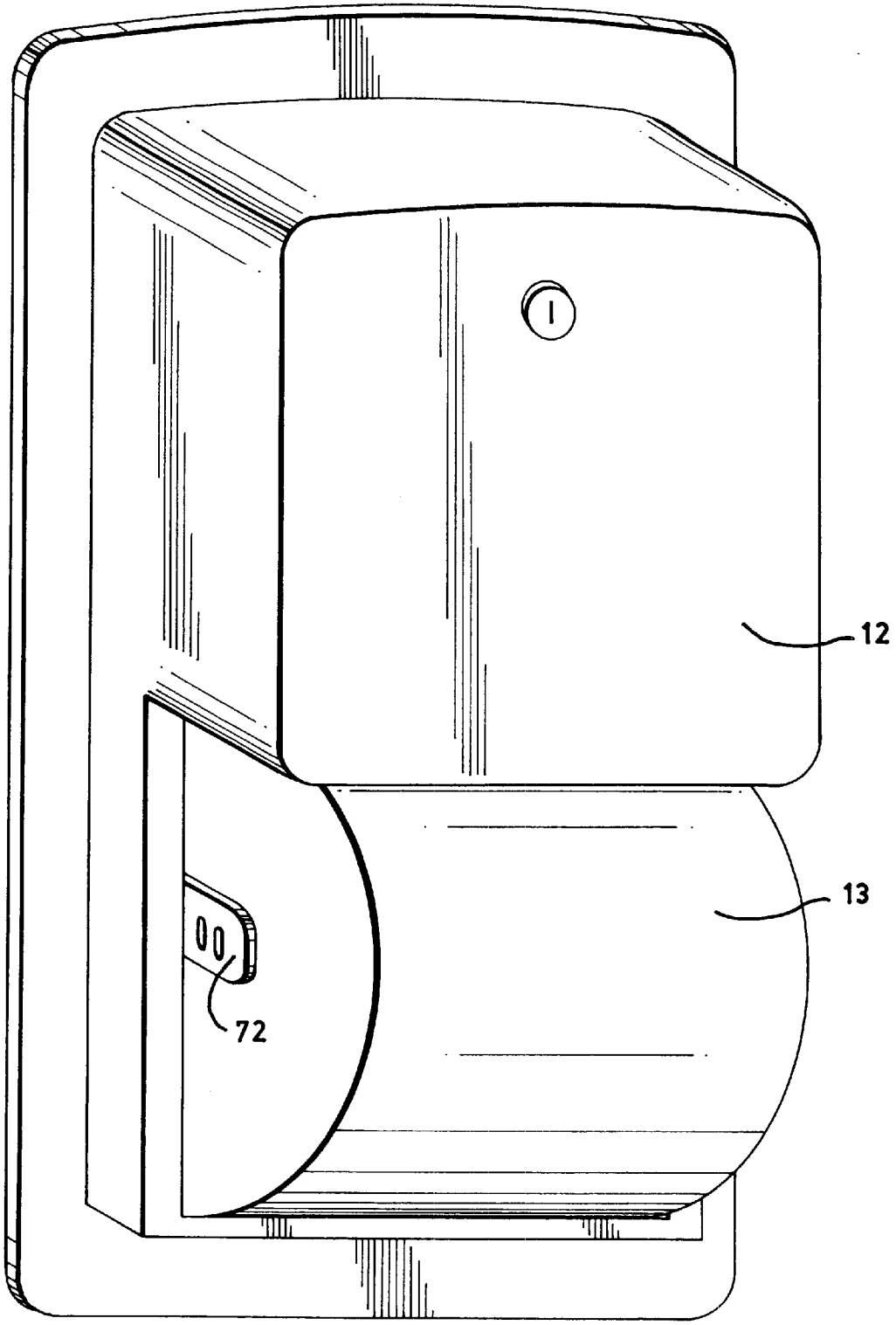
FIG. 5 is a perspective view of a dispenser including an adapter according to the present invention.
Figure 6:
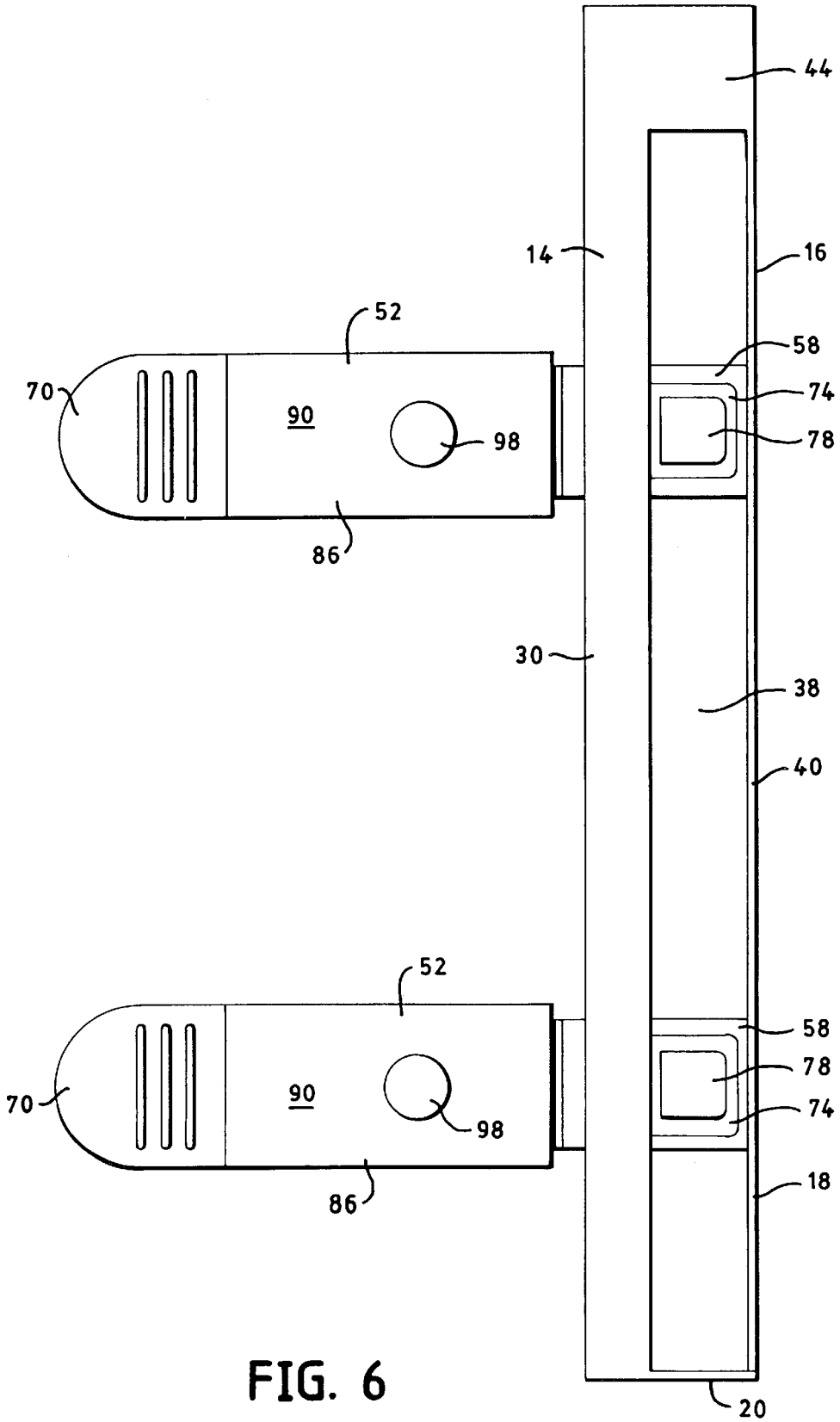
FIG. 6 is a side view of an adapter according to the present invention, the adapter utilizing two carriage units.
Figure 7:
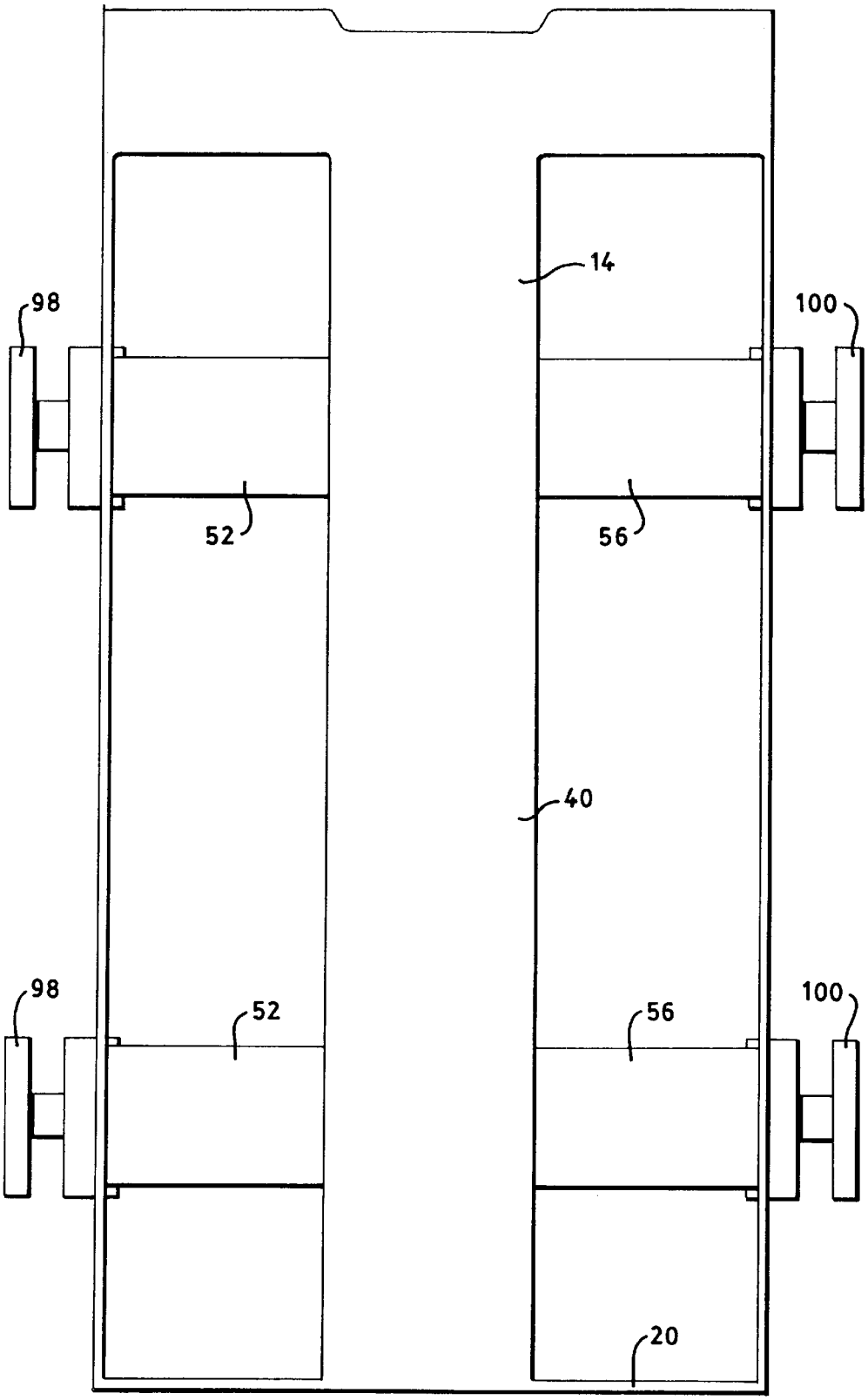
FIG. 7 is a rear view of an embodiment of the adapter.

In the embodiment depicted in FIG. 1, a single carriage unit 52 is shown. The carriage unit 52 depicted therein is adapted to carry a single roll of material which is shown at 13 in FIG. 5. As best depicted in FIGS. 2, 6 and 7, multiple carriage units may be utilized within the frame 14 so that multiple rolls of material 13 may be dispensed therefrom. Additionally, a single carriage unit 52 may be configured to carry a plurality of rolls of material. Selected embodiments of the carriage unit 52 may be configured to fit directly into a dispenser, eliminating the need for a frame.

The embodiment of the carriage unit 52 depicted in FIG. 3 includes a crossbar 54 having an outboard surface 56. The carriage unit 52 may further include a pair of arms 58 and 60, each arm extending from and attached to the crossbar 54. The arms 58 and 60 are spaced apart from each other and, in selected embodiments, are parallel to each other. In other embodiments, the arms 58 and 60 may be variously angled with respect to one another. Each arm 58 and 60 includes an inboard surface 62 and 64, respectively, as well as an outboard surface 66 and 68, respectively.

As shown in FIGS. 1, 3 and 4, each carriage unit 52 may be inserted into the channel 38 formed by the frame 14. The carriage unit 52 may be releasably locked to the frame 14 so that the carriage unit is slidable along the channel 38 of the frame 14, but does not slide out of the channel 38 and disengage the frame 14. In such embodiments, a locking mechanism may be provided which releasably locks the carriage unit 52 to the frame 14. Numerous locking mechanisms may be utilized in the present invention to releasably locking the carriage unit 52 to the frame 14.

In the embodiment shown in FIG. 1, locking mechanisms 71 and 73, respectively, are disposed on arms 58 and 60, respectively, of the carriage unit 52. As best shown in FIGS. 1 and 6, the locking mechanisms 71 and 73 include the apertures 74 and 76 which are formed in the arms 58 and 60, respectively. Disposed within each of the apertures 74 and 76 are the flexible locking fingers 78 and 80, respectively. As best illustrated in FIG. 3, each locking finger includes a locking shoulder 82 and a ramp 84. As the carriage unit 52 slides into engagement with the frame 14, the ramp 84 of each locking finger contacts the side rail 30 or 32. As the carriage unit 52 is further inserted into the channel 38, the locking fingers 78 and 80 are flexed inboard and away from the respective side rail of the frame 14. After the carriage unit 52 has been sufficiently seated into the channel 38 so that the outboard surface 56 of the crossbar 54 is as close as desired to the inboard surface 42 of the rear support 40, best shown in FIG. 1, the end of each ramp 84 is reached. The locking fingers 78 and 80 are then able to flex outwardly to their unbiased positions. The shoulder 82 of each locking finger 78 and 80 prevent the carriage unit 52 from withdrawing from the channel 38, as the shoulder 82 engages the back surface of the respective side rail. Thus, the locking fingers 78 and 80 maintain the carriage unit in engagement with the frame 14 while permitting the carriage unit 52 to freely slide within the channel 38 of the frame 14.

In certain embodiments and as shown in FIGS. 1, 3 and 6, each arm 58 and 60 may include a bracket 86 and 88, respectively. Each bracket 86 and 88 may be slidably or fixedly attached to the arms 58 and 60, respectively, of each carriage unit 52. The brackets 86 and 88 each include an outboard surface 90 and 92, respectively, and an inboard surface 94 and 96, respectively. In embodiments which do not include a bracket 86 or 88, the inboard surfaces 94 and 96 and outboard surfaces 90 and 92 are formed on the arms 58 and 60, respectively.

Inboard pins 104 and 106 are disposed on the inboard surfaces 94 and 96, respectively. Each inboard pin 104 and 106 is adapted to engage solid or coreless rolls which have recesses or divots defined in the vertical sides thereof that also may define a rotating axis for the solid or coreless rolls. Specifically, the inboard pins 104 and 106 engage the recesses, divots, detents or aperture of the roll of material. Alternate embodiments of the inboard pins 104 and 106 may be configured to engage rolls of materials having solid or hollow cores. In the embodiments depicted in FIGS. 3 and 4, each inboard pin 104 and 106 is rotatable with respect to the inboard surfaces 94 and 96, respectively, so that, when the inboard pin 104 or 106 engages the coreless roll, the roll rotates and material may be removed therefrom. Various configurations of the inboard pins may accomplish this.

In some embodiments, the inboard pins 104 and 106 and outboard pins 98 and 100 may be removably attached to their respective surfaces so that a user may install inboard pins configured for a particular type of rolled material and outboard pins configured for a particular dispenser. In such embodiments, the user may remove the pins and install differently configured pins which may be adapted for a different purpose. Additionally, pins which are removably attached enable a user to easily replace worn or broken pins. As shown in FIG. 7, the outboard pins may be configured so that the outermost portion of the pin is spaced apart from the arms 58 and 60. The distance by which the outermost portion of the pin is spaced from the arms may be varied to meet the requirements of a particular dispenser.

In selected embodiments, the brackets 86 and 88 are slidably attached to the arms 58 and 60. In some embodiments, this will permit a roll of material 13 to be loaded onto the brackets 86 and 88 without necessitating removal of the carriage unit 52 from the frame 14. In selected embodiments, the direction of motion of the brackets 86 and 88 along the arms 58 and 60, respectively, of the carriage unit 52 is substantially normal to the direction of motion of the carriage unit 52 within the channel 38 of the frame 14.

The adapter 10 of the present invention is useful with a variety of dispensers for storing and dispensing multiple rolls of a solid or coreless rolled material. Many such dispensers includes a dispenser frame having side wall members, a front cover, and a dispensing opening on a front side thereof. The side wall members may have generally vertically oriented and oppositely facing slots or pathways defined on inside surfaces thereof.

Figure 8:
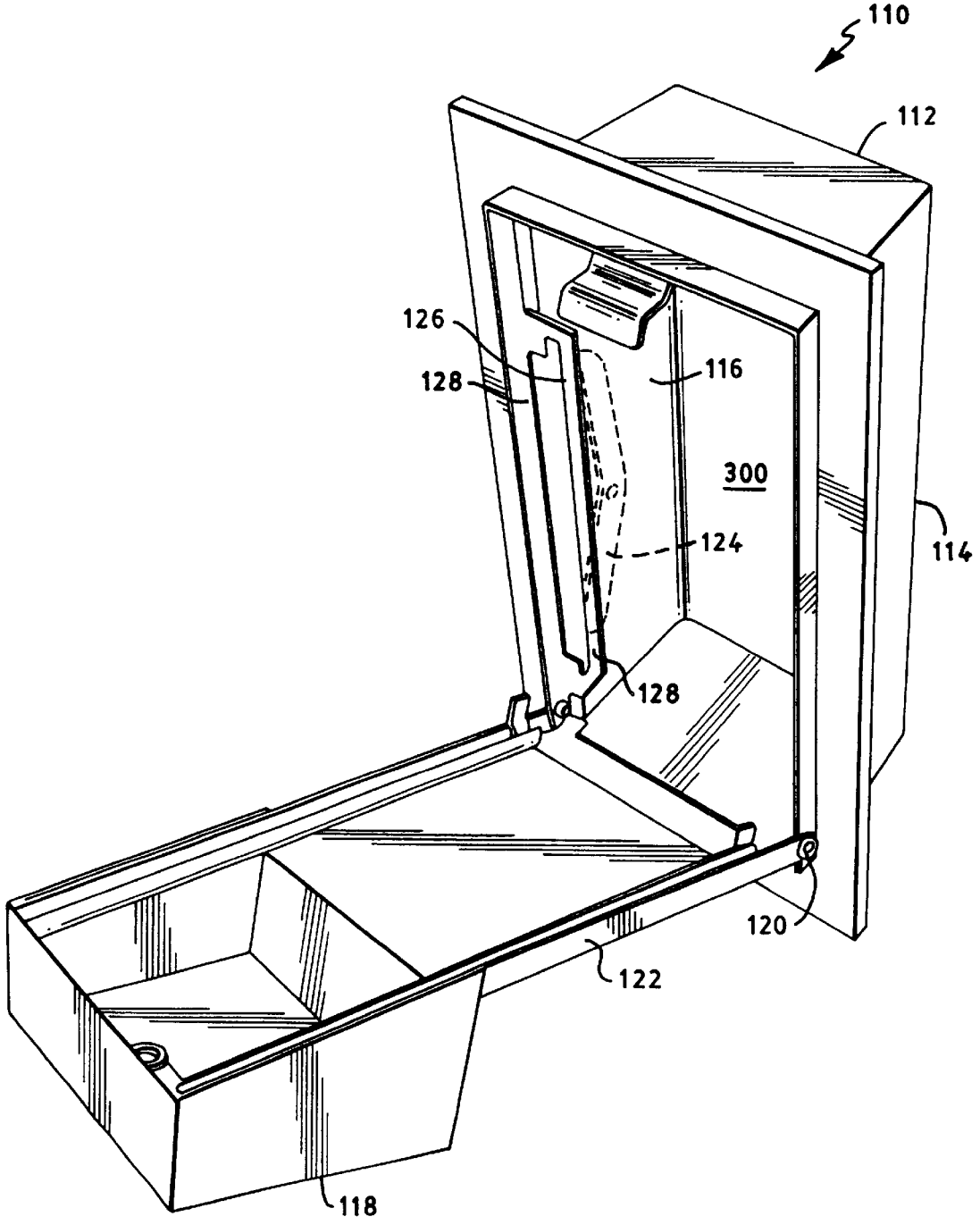
FIG. 8 is a view of a dispenser which may be utilized with the adapters of the present invention.

One such dispenser 110 is shown in FIG. 8 which is formed of a dispenser frame 112 having side walls 114. The side walls 114 include an inner surface 116. The dispenser 110 also may include a front cover member 118 that pivots away from the dispenser frame 112 at pivot points 120. The cover 118 may also include an opening defining the dispensing position of the lowermost roll and may further include vertical arms 122 that attach to the dispenser frame 112 at the pivot point 120. Alternatively, a bottom portion of the dispenser may contain an opening that defines the dispensing position for the lowermost roll. A rocker arm 124 is illustrated as housed within the structure 126 defining a slot 128. The operation of rocker arm 124 is also understood by those skilled in the art and generally serves to hold an upper roll of material above the dispensing position of a lower roll until the lower roll has been depleted. When such a dispenser is used with the adapter 10 of the present invention, the outboard pins 98 and 100, shown in FIG. 1, engage the slots 128. Once the lower roll has been depleted, a carriage unit 52 carrying the lower roll slides downward to a lowermost position in the slots 128, which allows the rocker arm 124 to pivot and permit the upper roll of material to fall into the dispensing position.

A more detailed explanation of the dispenser frame and components is not necessary for purposes of the present disclosure. Such conventional dispensers have typically been used to dispense multiple vertical rolls of tissue paper having hollow cores.

In selected embodiments, the inboard pins 104 and 106 of the carriage unit 52 may extend at least partially into the divot or recess defined in the side of the roll and also may include a rolling surface against which the additional vertically disposed roll may rest and rolls within the dispenser once the first solid core roll held by the adapters has been used. In other words, once a first roll of material is depleted, desirably the second vertically oriented roll will fall into a dispensing position within the dispenser and the carriage unit will fall to the bottom of the dispenser slots and be retained therein until the dispenser is opened for replacement of the rolls. When the second roll falls into its dispensing position, the circumference of the second roll will rest on and roll against the inboard pins 104 and 106, particularly on the rolling surface defined by the inboard pins. In one embodiment, the rolling surface may be generally horizontal. In an alternative embodiment, the rolling surface may be conical in shape. Any number of various shapes and configurations may be used to define such rolling surfaces.

The adapter may be secured to the dispenser in a variety of ways, including using mechanical fasteners, adhesive or the like. In selected embodiments, it may be desirable to releasably secure the adapter to the dispenser, as this permits the adapter to be easily removed so that the dispenser may be quickly converted to dispense cored rolls of material or coreless rolls of material.

Figure 9:
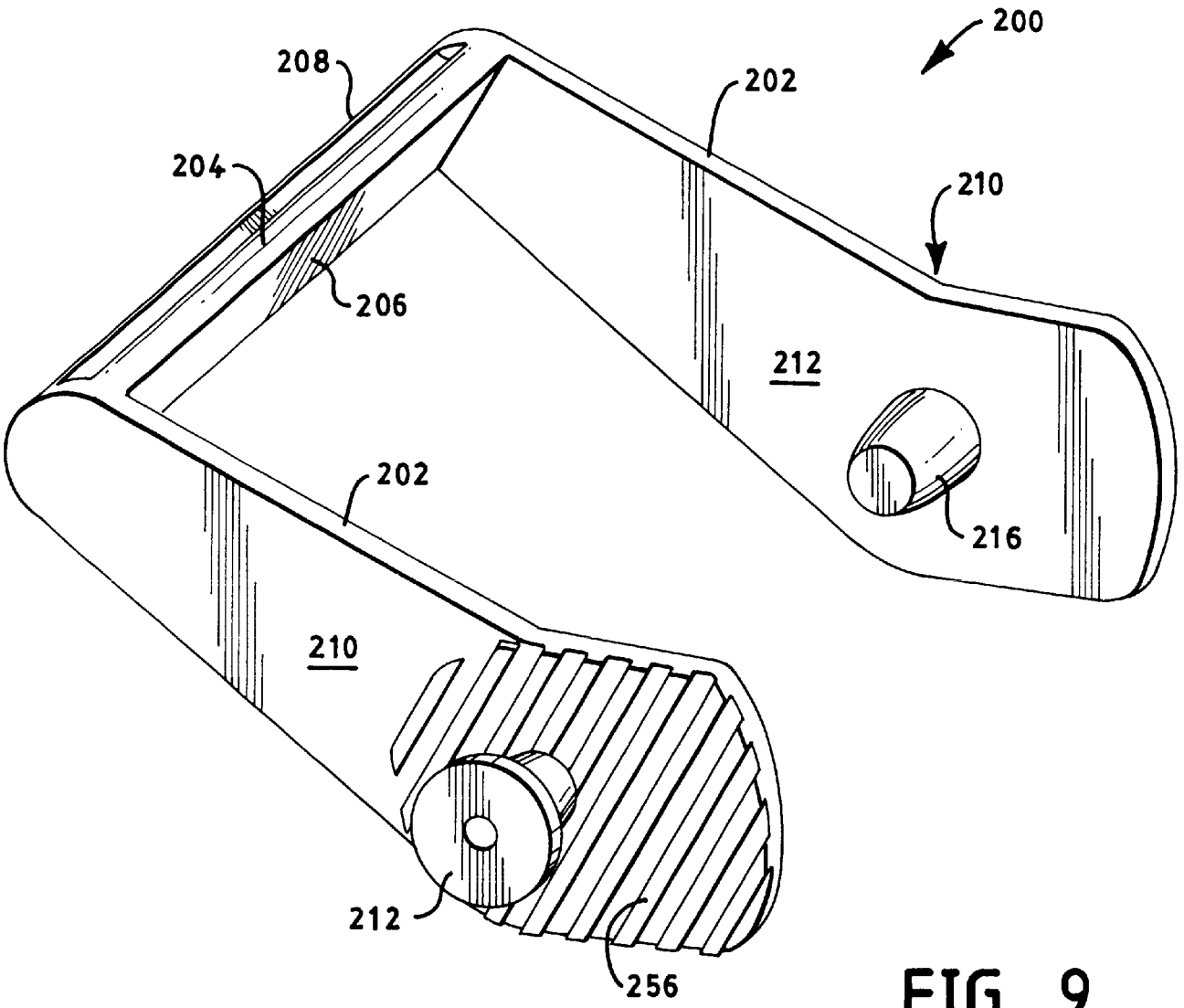
FIG. 9 is a left perspective view of an exemplary carriage unit adapter.

Referring now to FIG. 9, there is shown not necessarily to scale, a perspective view of an exemplary carriage unit adapter 200. The carriage unit adapter 200 is for solid or coreless rolls of paper material that are dispensed in a roll dispenser 110 of the type shown in FIG. 8 having side walls 114 having slots 128 on inner surfaces 116 thereof for receipt of said adapter and a back wall 300 positioned a distance from the slots that is slightly greater than the radius of a solid or coreless roll, the solid or coreless rolls having recesses defined in sides thereof defining a rotating axis for said solid or coreless rolls.

According to the invention, the carriage unit adapter 200 includes a pair of spaced apart arms 202 joined by a connecting member 204 having a front surface 206 and a back surface 208. Each arm has an outboard surface 210 and an inboard surface 212. An outboard pin 214 is disposed on the outboard surface 210, the outboard pin is configured to slidably engage a slot 128 on an inner surface 116 of a side wall 114 of the dispenser 110 (see FIG. 8). An inboard pin 216 attached to the inboard surface 212, the inboard pin 216 is configured to engage a coreless roll of material. The outboard pin 214 and/or the inboard pin 216 may be fixed or configured to rotate.

Each arm 202 has a length "L" measured from the back surface 208 of the connecting member 204 to the center of the outboard pin 214 that is greater than a distance "D" between the slots 128 and the back wall 300 of the dispenser 110 (see FIG. 8) so that the back surface 208 of the connecting member 204 contacts the back wall 300 of the dispenser 110 to force the connecting member 204 out of the same planar dimension "P" as the outboard pins 214 as they engage the slots 128. This permits the carriage unit 200 to hold the roll within the roll dispenser 110 while allowing said carriage unit to move along the slots 128 of the roll dispenser to a dispensing position without interfering with the positioning of subsequent rolls.

Figure 11:
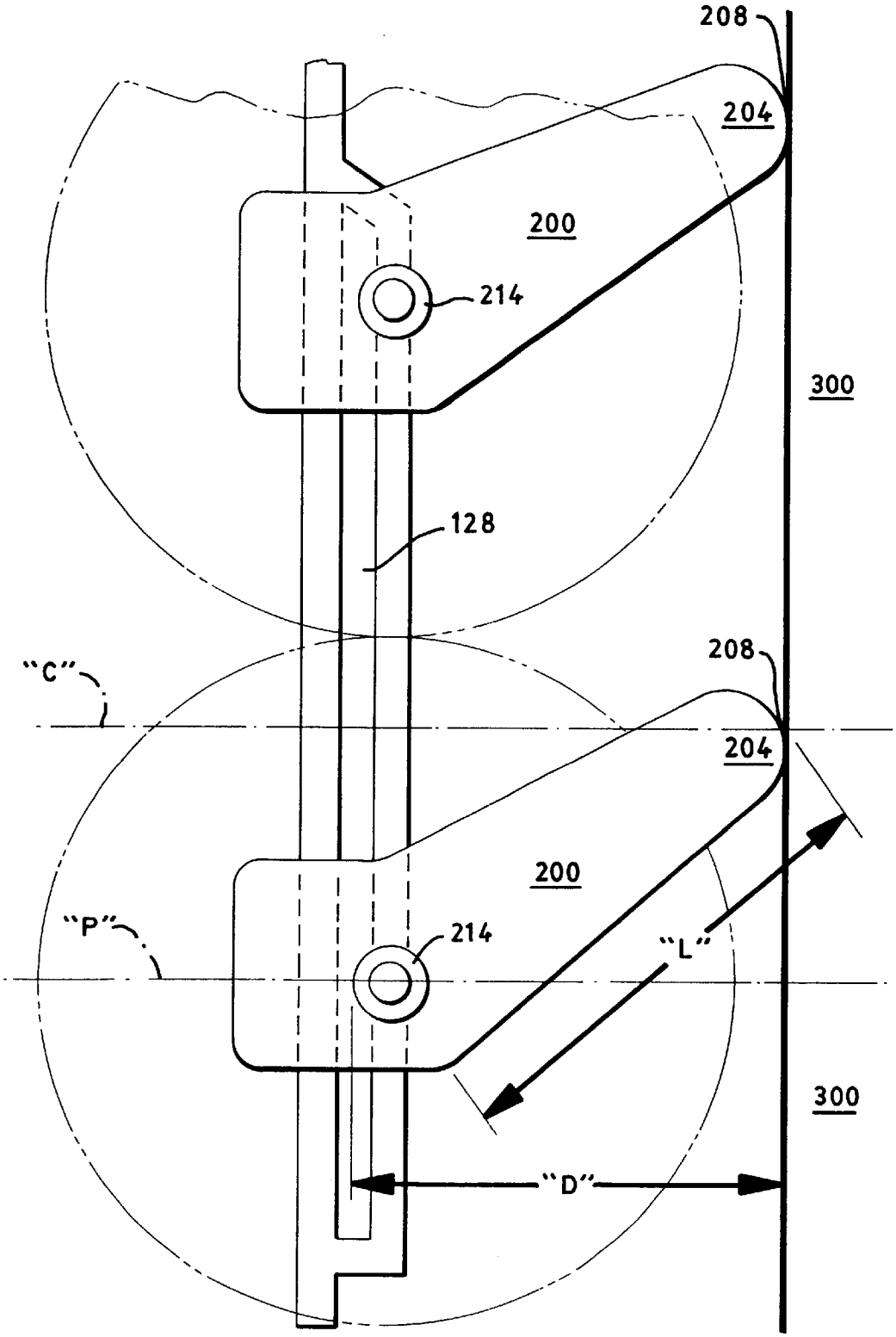
FIG. 11 is an enlarged view of a side wall of an exemplary dispenser illustrating an arrangement of multiple carriage unit adapters and coreless rolls.
Figure 12:
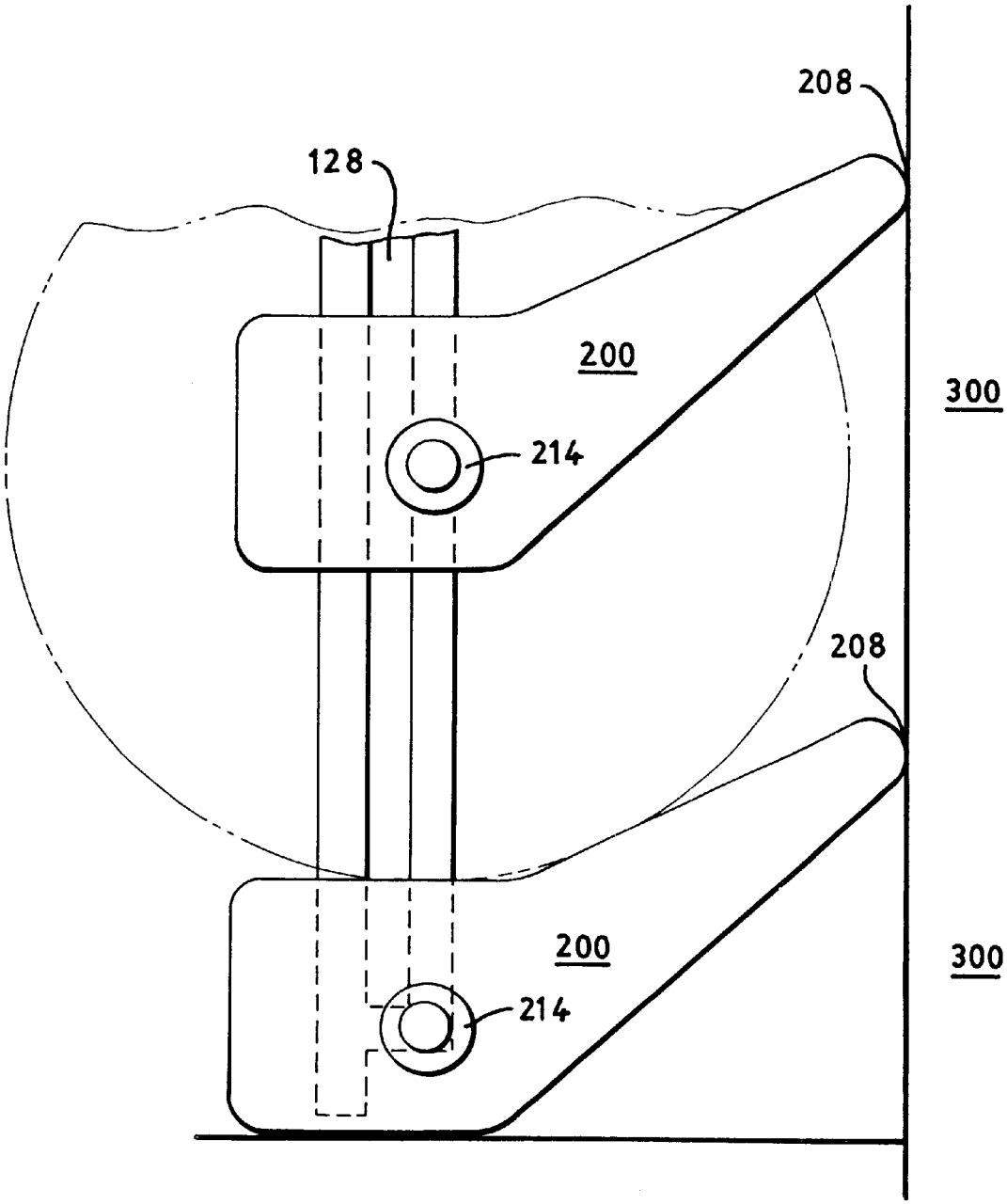
FIG. 12 is an enlarged view of a side wall of an exemplary dispenser illustrating an arrangement in which a second carriage unit adapter and coreless roll has dropped into dispensing position.

This is shown in greater detail in FIGS. 11 and 12. In FIG. 11, two coreless rolls of product are held in separate carriage units 200. The outboard pin 214 engages the slot 128. As can been seen, the length "L" is greater than the distance "D". This causes the connecting member 204 to be positioned in planar dimension "C" that is not the same as planar dimension "P" in which the outboard pin 214 is located. In FIG. 12, it can be seen that one of the coreless rolls is depleted and a carriage unit 200 had dropped to the bottom of the dispenser and a second or reserve roll and its corresponding carriage unit adapter has dropped down to a dispensing position.

Figure 13:
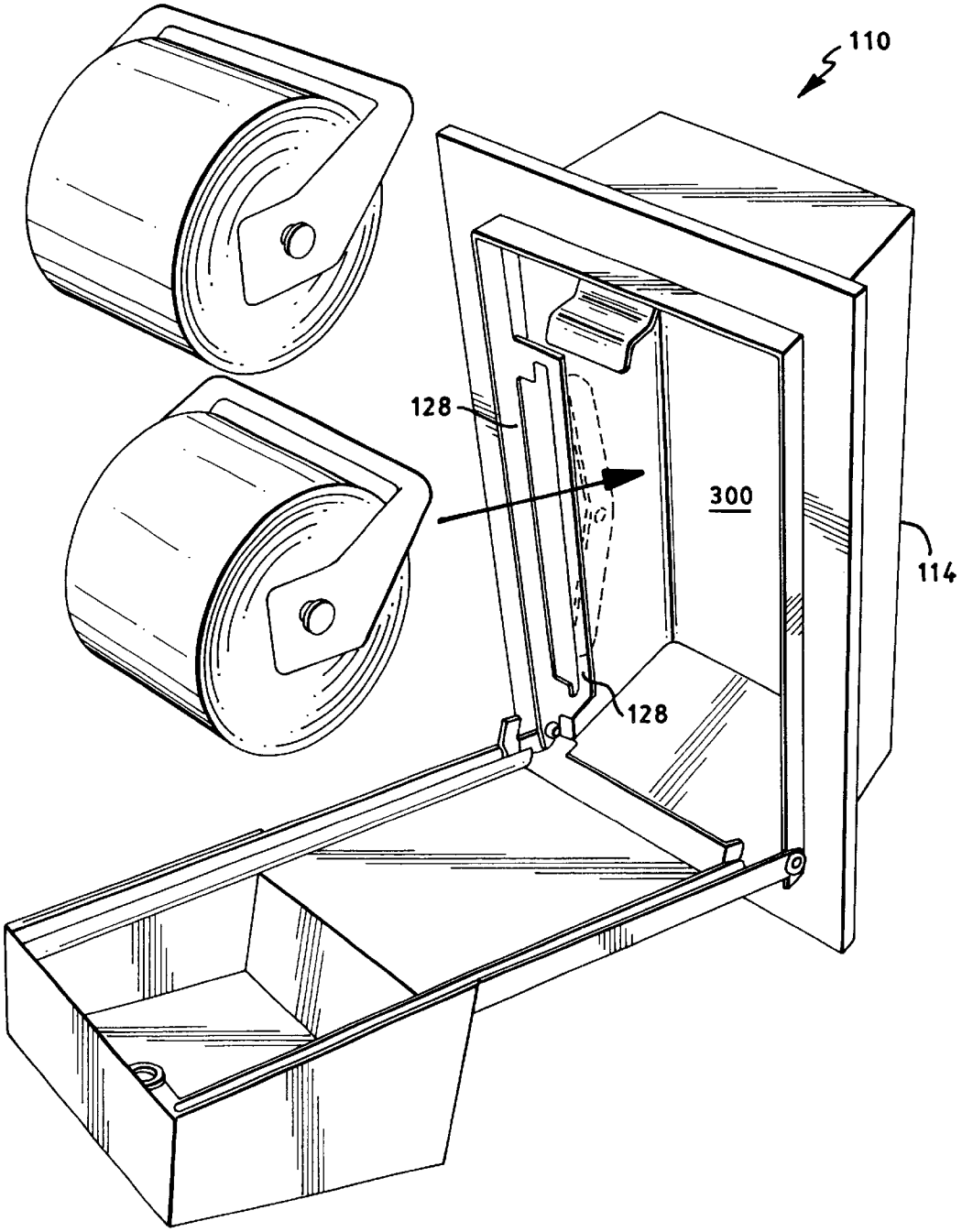
FIG. 13 is a perspective view of an exemplary dispenser and further illustrates exemplary carriage unit adapters and coreless rolls.

FIG. 13 gives a overall perspective view of how the coreless rolls and carriage unit adapters 200 are fitted into the dispenser 110.

Figure 10:
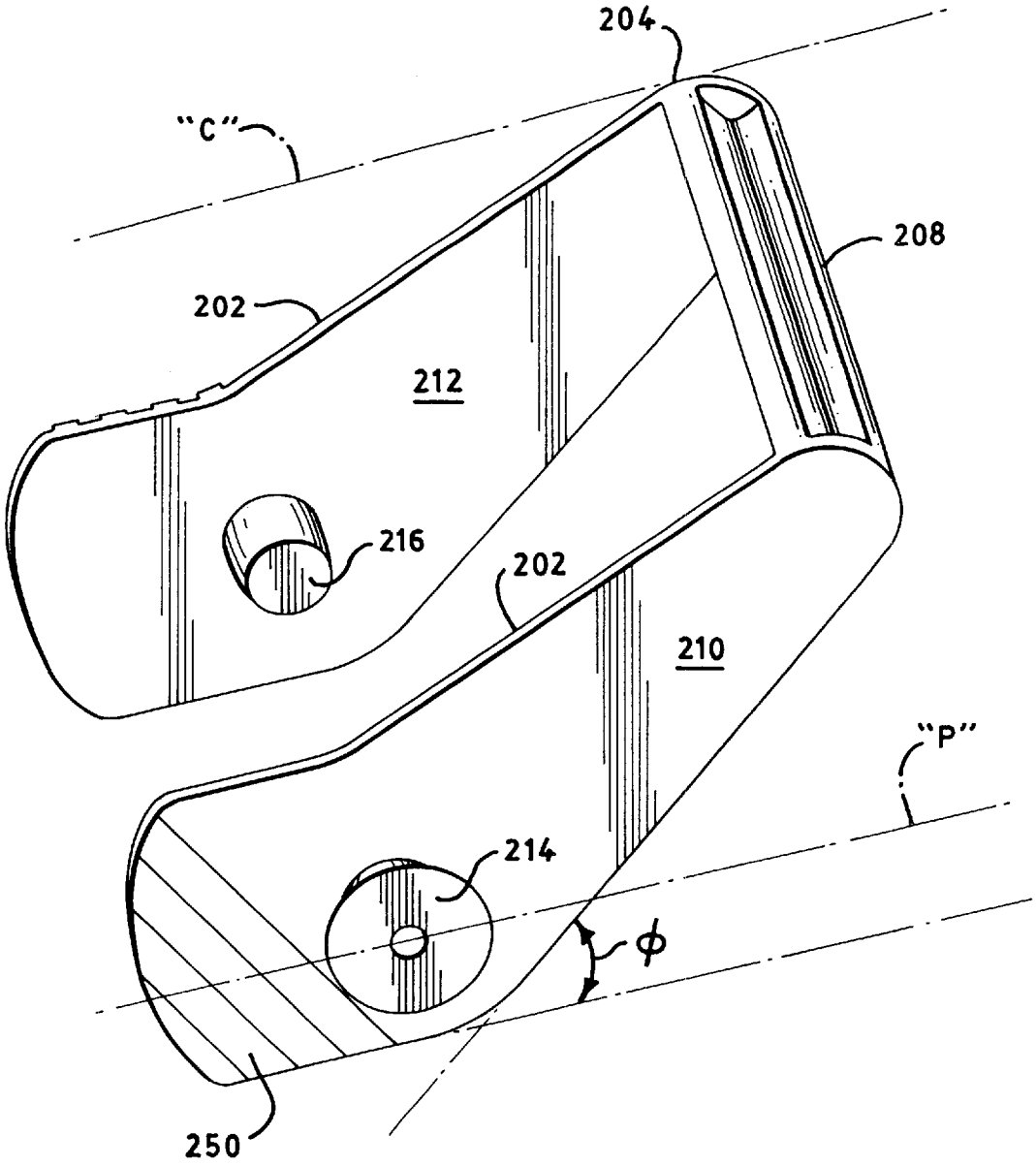
FIG. 10 is a right perspective view of an exemplary carriage unit adapter.

Referring now to FIG. 10, there is shown a perspective view of a carriage unit adapter. Each spaced apart arm 202 can be offset to orient to connecting member 204 so it is out of the same planar dimension "P" as the outboard pins 214 as the pins engage the slots 128. For example, each spaced apart arm may be offset at an angle $\phi$ ranging from about 10 degrees to about 75 degrees. As another example, each spaced apart arm may be offset at an angle $\phi$ ranging from about 30 degrees to about 50 degrees. As yet another example, each spaced apart arm may be offset at an angle $\phi$ of about 40 degrees.

The carriage unit adapter 200 may also include finger placement indicia 250 and thumb placement indicia 252 (see FIG. 9) on separate spaced apart arms. In this particular configuration, the finger and thumb placement indicia are position for the carriage unit adapter to be gripped by an individual's right hand. These indicia help an individual gripping the carriage unit adapter to hold it properly so that the connecting member is oriented upward (i.e., toward the top of a dispenser) so the carriage unit holds the roll within said roll dispenser while allowing said carriage unit to move along said slots defined in said roll dispenser to a dispensing position. Importantly, if the carriage unit adapter was gripped incorrectly and installed upside down, the roll would not dispense properly.

The finger placement indicia 250 may have a smaller area than the thumb placement indicia 252 to generally correspond to the contact area of the respective finger and thumb on the carriage unit when gripped correctly. It may be desirable to use different textures or patterns for each indicia. For example, the finger placement indicia 250 may be a series of insets or grooves and the thumb placement indicia 252 may be a series of bumps or ridges to provide different tactile properties to help an individual identify the proper grip points that produce to the correct installation position.

Figure 14:
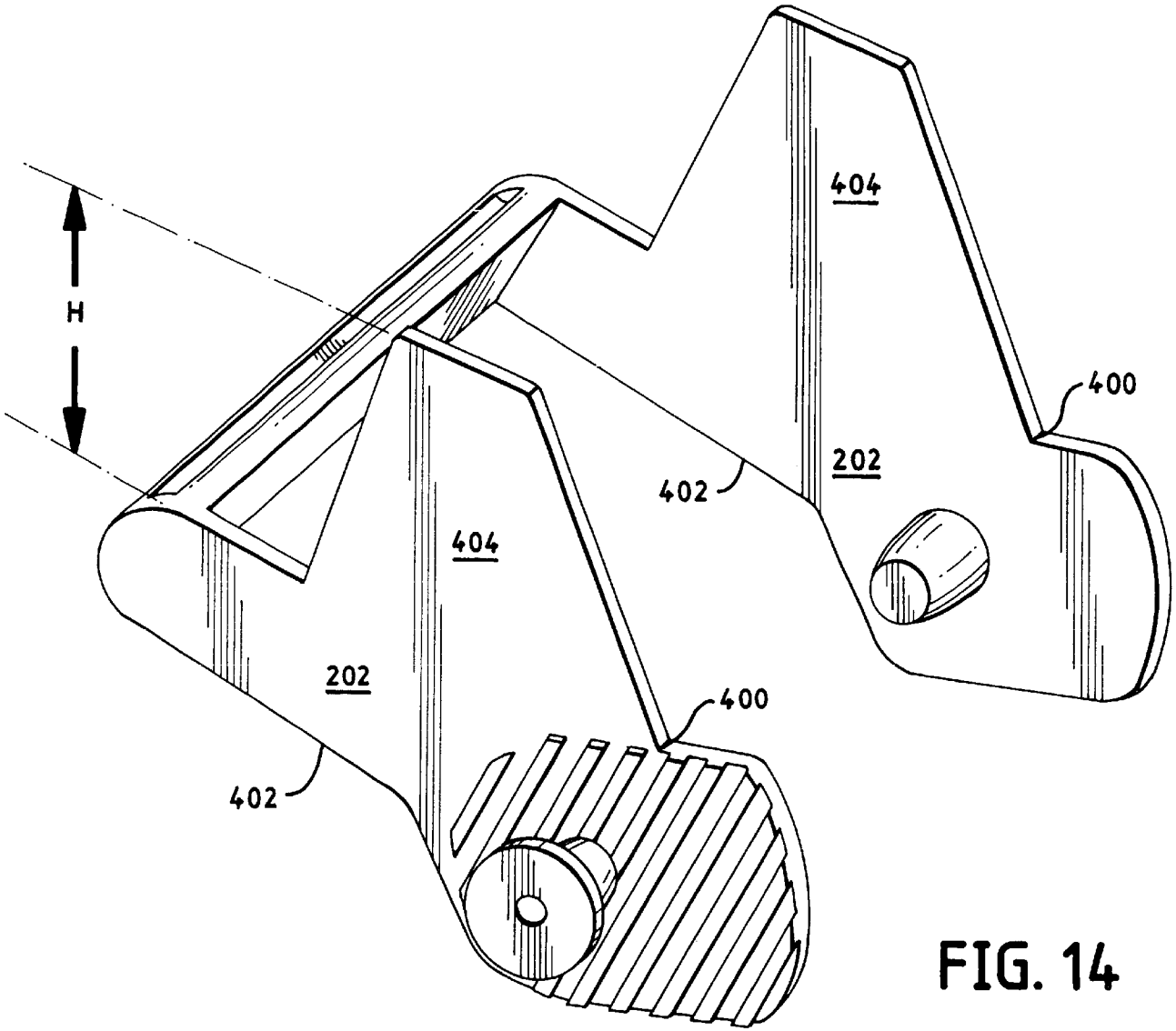
FIG. 14 is a left perspective view of an exemplary stackable carriage unit adapter.
Figure 15:
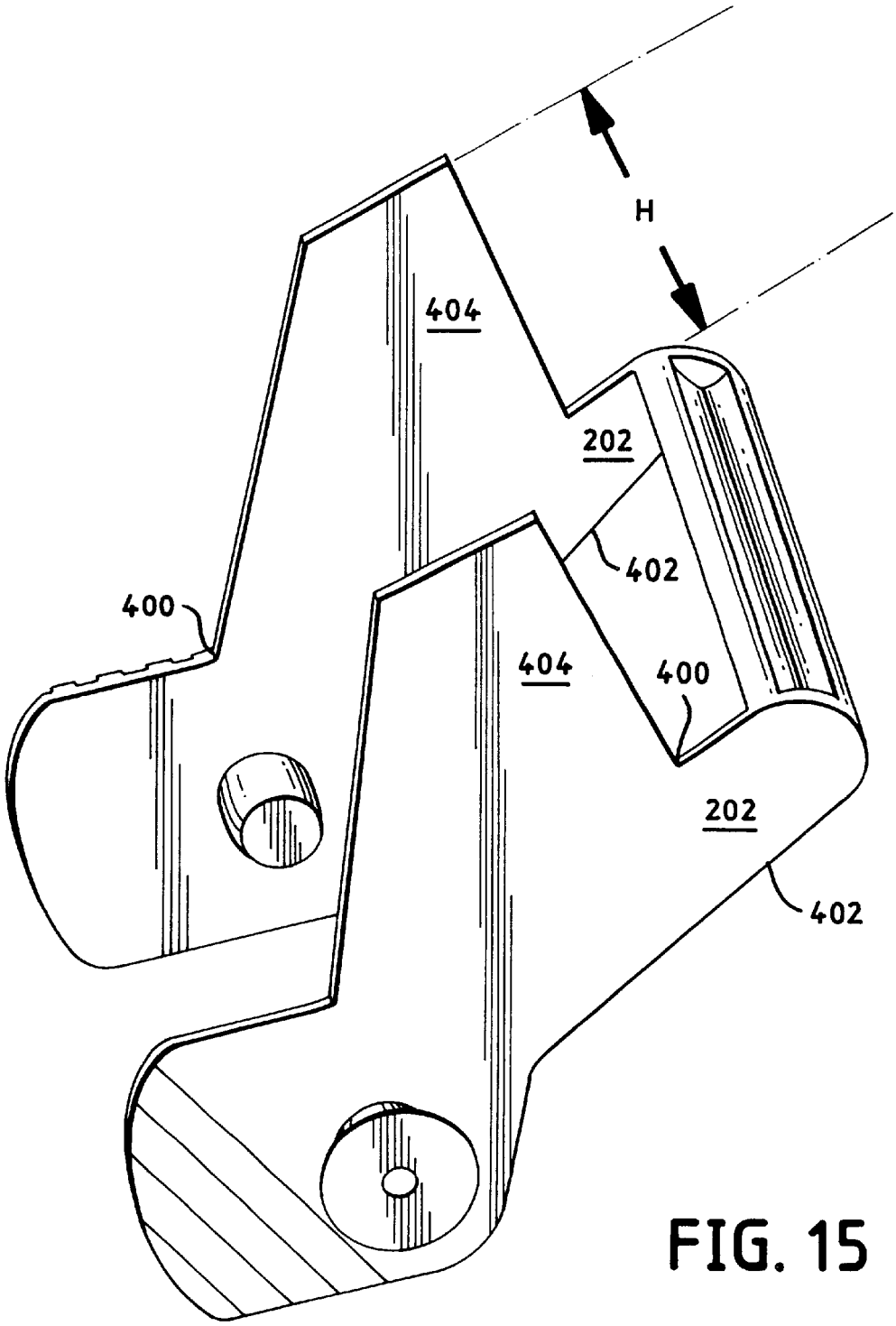
FIG. 15 is a right perspective view of an exemplary stackable carriage unit adapter.

Referring now to FIG. 14, there is shown not necessarily to scale, a perspective view of an alternative embodiment of the carriage unit adapter 200 which is configured or adapted to be stackable. The carriage unit is essentially the same as the unit shown in FIG. 9. However, the stackable unit also includes vertical separation elements.

In particular, each spaced apart arm 202 further includes an upper surface 400 and a lower surface 402. A vertical separation element 404 is located on at least a portion of the upper surface 400 of each of the spaced apart arms 202.

Generally speaking, the vertical separation elements 404 each may have a vertical height "H" that is approximately the same as the radius of a full roll of paper material to be dispensed. This height may be adjusted for several factors including, but not limited to, the dimensions of the dispenser.

During conventional operation, as shown for example in FIG. 11, a dispensing roll and a reserve roll are held in place. As the lower dispensing roll becomes depleted, the roll and carriage unit drops down or slides down the slots in the inner surfaces of the dispenser.

However, in some situations, as the lower dispensing roll becomes substantially depleted, the reserve roll drops down on top of the dispensing roll.

Figure 16:
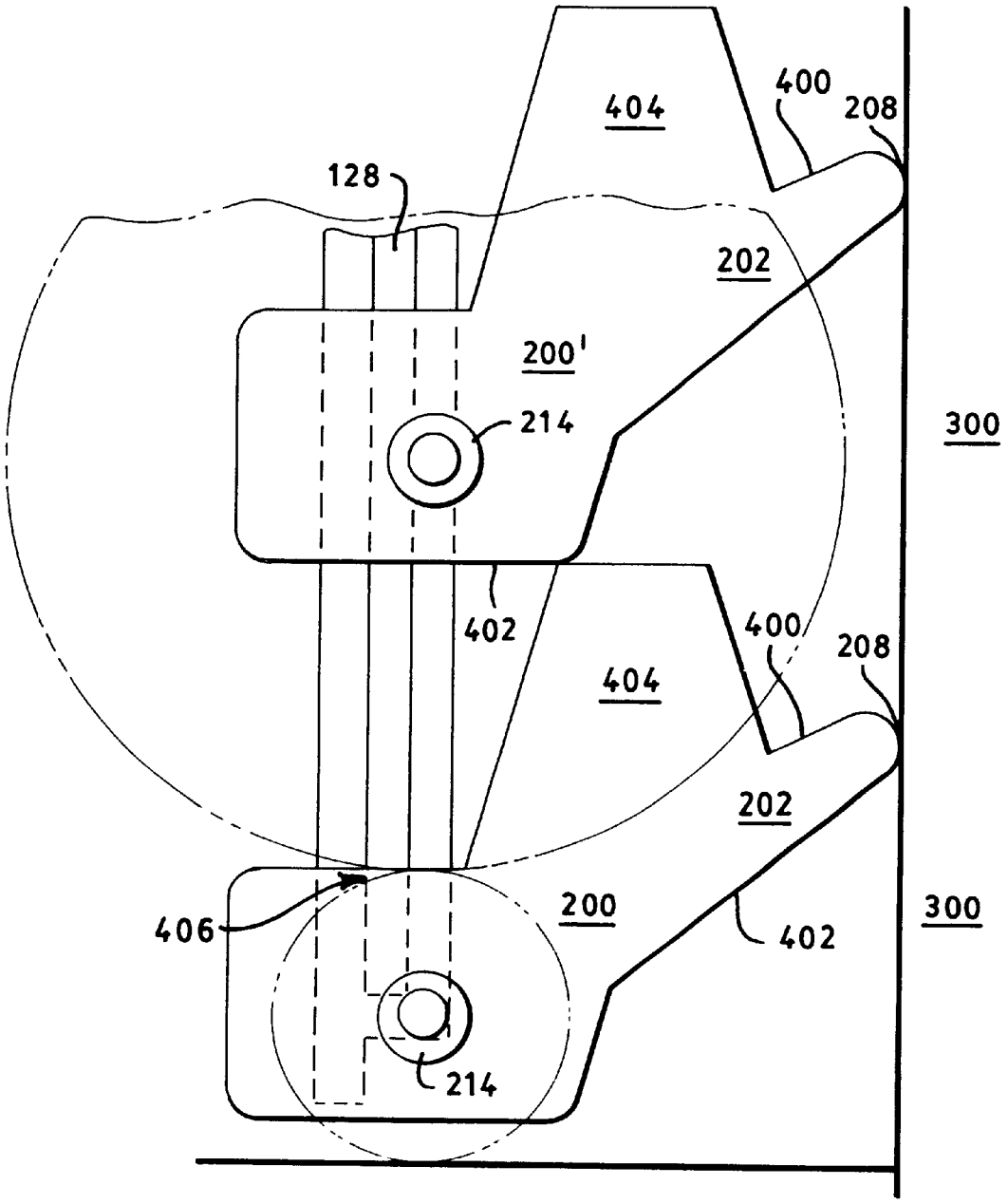
FIG. 16 is an enlarged view of a side wall of an exemplary dispenser illustrating an arrangement in which a second stackable carriage unit adapter and coreless roll has dropped into dispensing position.

According to an embodiment of the invention shown at, for example in FIG. 16, the vertical separation element 404 of a first carriage unit 200 is adapted to contact or engage at least a portion of the lower surfaces 402 of the spaced apart arms 202 of a second carriage unit 200' when the second carriage unit is positioned directly on top of the first carriage unit.

Desirably, the vertical separation element 404 of the first carriage unit 200' is adapted to contact or engage at least a portion of the lower surfaces 402 of the spaced apart arms 202 of the second carriage unit 200' when the roll of paper product held in the first carriage unit is substantially depleted.

The vertical separation elements 404 of the lower or bottom carriage unit 200 should have sufficient height "H" so that when they contact at least a portion of the lower surfaces 402 of the upper or second carriage unit 200' holding a reserve roll, sufficient separation exists to create a gap 406 between the substantially depleted dispensing roll and the reserve roll held by the upper or second carriage unit. The gap 406 need only have sufficient dimension to prevent the reserve roll from interfering with easy and reliable dispensing of the substantially depleted dispensing roll. For example, the gap 406 may be one or two millimeters. Desirably, the gap 406 may be about five millimeters. It is contemplated that the gap 406 may be greater than five millimeters, such as ten, fifteen or twenty millimeters or greater.

It should be appreciated by those skilled in the art that the particular dimensions of the adapters of the present invention will vary depending on the type of dispenser used. It is well within the purview of one skilled in the art to determine the optimal dimensions for these adapters depending on the type of dispenser the adapters are intended to be used with. It should also be appreciated by those skilled in the art that various modifications and variations can be made in the present invention. The present inventive adapters are described and illustrated as utilized in dispensers. It is within the scope and spirit of the invention that the adapters be used with any type of dispenser wherein multiple rolls of solid or coreless material are housed and moved therein to a dispensing position. The adapters are not limited to use with dispensers. It is intended that the present invention cover such modifications and variations as come within the scope and spirit of the appended claims and their equivalents.

What is claimed is:

1. A carriage unit adapter for solid or coreless rolls of paper material that are dispensed in a roll dispenser having slots defined on inner surfaces of side wall members thereof for receipt of said adapter and a back wall positioned a distance from the slots that is slightly greater than the radius of a solid or coreless roll, the solid or coreless rolls having recesses defined in sides thereof defining a rotating axis for said solid or coreless rolls, the carriage unit adapter comprising:

a pair of spaced apart arms joined by a connecting member having a front surface and a back surface, each arm having an outboard surface and an inboard surface including:

(i) an outboard pin disposed on the outboard surface, the outboard pin configured to slidably engage a slot on an inner surface of a side wall member of the dispenser; and (ii) an inboard pin attached to the inboard surface, the inboard pin configured to engage a coreless roll of material, each arm further having a length measured from the back surface of the connecting member to the center of the outboard pin that is greater than the distance between the slots and the back wall of the dispenser so that the back surface of the connecting member contacts the back wall of the dispenser to force the connecting member out of the same planar dimension as the outboard pins as they engage the slots;

wherein the carriage unit holds said roll within said roll dispenser while allowing said carriage unit to move along said slots defined in said roll dispenser to a dispensing position.

2. The carriage unit adapter of claim 1, wherein each spaced apart arm is offset to orient to connecting member out of the same planar dimension as the outboard pins as they engage the slots.

3. The carriage unit adapter of claim 1, wherein each spaced apart arm is offset at an angle ranging from about 10 degrees to about 75 degrees.

4. The carriage unit adapter of claim 3, wherein each spaced apart arm is offset at an angle ranging from about 30 degrees to about 50 degrees.

5. The carriage unit adapter of claim 1, further comprising finger placement indicia and thumb placement indicia on separate spaced apart arms.

6. The carriage unit adapter of claim 1, wherein each spaced apart arm further includes an upper surface and a lower surface and a vertical separation element located on at least a portion of the upper surface of each of the spaced apart arms.

7. The carriage unit of claim 6, wherein the vertical separation elements each have a vertical height that is approximately the same as the radius of a full roll of paper material to be dispensed.

8. The carriage unit of claim 6, wherein the vertical separation element of a first carriage unit is adapted to contact or engage at least a portion of the lower surfaces of the spaced apart arms of a second carriage unit when the second carriage unit is positioned directly on top of the first carriage unit.

9. The carriage unit of claim 8, wherein the vertical separation element of the first carriage unit is adapted to contact or engage at least a portion of the lower surfaces of the spaced apart arms of the second carriage unit when the second carriage unit is positioned directly on top of the first carriage unit and when the roll of paper product held in the first carriage unit is substantially depleted.

10. A stackable carriage unit adapter for solid or coreless rolls of paper material that are dispensed in a roll dispenser having slots defined on inner surfaces of side wall members thereof for receipt of said adapter and a back wall positioned a distance from the slots that is slightly greater than the radius of a solid or coreless roll, the solid or coreless rolls having recesses defined in sides thereof defining a rotating axis for said solid or coreless rolls, the carriage unit adapter comprising:

a pair of spaced apart arms joined by a connecting member having a front surface and a back surface, each arm having an outboard surface and an inboard surface including:

(i) an outboard pin disposed on the outboard surface, the outboard pin configured to slidably engage a slot on an inner surface of a side wall member of the dispenser; and (ii) an inboard pin attached to the inboard surface, the inboard pin configured to engage a coreless roll of material, each arm further having a length measured from the back surface of the connecting member to the center of the outboard pin that is greater than the distance between the slots and the back wall of the dispenser so that the back surface of the connecting member contacts the back wall of the dispenser to force the connecting member out of the same planar dimension as the outboard pins as they engage the slots; and each arm further including an upper surface and a lower surface and a vertical separation element located on at least a portion of the upper surface of each of the spaced apart arms;

wherein the carriage unit holds said roll within said roll dispenser while allowing said carriage unit to move along said slots defined in said roll dispenser to a dispensing position.

11. The carriage unit of claim 10, wherein the vertical separation elements each have a vertical height that is approximately the same as the radius of a full roll of paper material to be dispensed.

12. The carriage unit of claim 10, wherein the vertical separation element of a first carriage unit is adapted to contact or engage at least a portion of the lower surfaces of the spaced apart arms of a second carriage unit when the second carriage unit is positioned directly on top of the first carriage unit.

13. The carriage unit of claim 12, wherein the vertical separation element of the first carriage unit is adapted to contact or engage at least a portion of the lower surfaces of the spaced apart arms of the second carriage unit when the second carriage unit is positioned directly on top of the first carriage unit and when the roll of paper product held in the first carriage unit is substantially depleted.

14. The carriage unit adapter of claim 10, wherein each spaced apart arm is offset to orient to connecting member out of the same planar dimension as the outboard pins as they engage the slots.

15. The carriage unit adapter of claim 10, wherein each spaced apart arm is offset at an angle ranging from about 10 degrees to about 75 degrees.

16. The carriage unit adapter of claim 10, further comprising finger placement indicia and thumb placement indicia on separate spaced apart arms.

17. A stackable carriage unit adapter for solid or coreless rolls of paper material that are dispensed in a roll dispenser having slots defined on inner surfaces of side wall members thereof for receipt of said adapter and a back wall positioned a distance from the slots that is slightly greater than the radius of a solid or coreless roll, the solid or coreless rolls having recesses defined in sides thereof defining a rotating axis for said solid or coreless rolls, the carriage unit adapter comprising:

a pair of spaced apart arms joined by a connecting member having a front surface and a back surface, each arm having an outboard surface and an inboard surface including:

(i) an outboard pin disposed on the outboard surface, the outboard pin configured to slidably engage a slot on an inner surface of a side wall member of the dispenser; and (ii) an inboard pin attached to the inboard surface, the inboard pin configured to engage a coreless roll of material, each arm further having a length measured from the back surface of the connecting member to the center of the outboard pin that is greater than the distance between the slots and the back wall of the dispenser so that the back surface of the connecting member contacts the back wall of the dispenser to force the connecting member out of the same planar dimension as the outboard pins as they engage the slots; and each arm further including an upper surface and a lower surface and a vertical separation element located on at least a portion of the upper surface of each of the spaced apart arms so that the vertical separation element of a first carriage unit is adapted to contact or engage at least a portion of the lower surfaces of the spaced apart arms of a second carriage unit when the second carriage unit is positioned directly on top of the first carriage unit;

wherein the carriage unit holds said roll within said roll dispenser while allowing said carriage unit to move along said slots defined in said roll dispenser to a dispensing position.

18. The carriage unit of claim 17, wherein the vertical separation elements each have a vertical height that is approximately the same as the radius of a full roll of paper material to be dispensed.

19. The carriage unit of claim 17, wherein the vertical separation element of the first carriage unit is adapted to contact or engage at least a portion of the lower surfaces of the spaced apart arms of the second carriage unit when the second carriage unit is positioned directly on top of the first carriage unit and when the roll of paper product held in the first carriage unit is substantially depleted.

* * * * *